US006045213A

United States Patent [19]

Kishimoto et al.

[11] Patent Number: 6,045,213

[45] Date of Patent: Apr. 4, 2000

[54] INK JET HEAD HAVING AN IMPROVED COATING IN AN INK PRESSURE CHAMBER AND A METHOD OF MANUFACTURING THE SAME

[75] Inventors: Mitsuru Kishimoto; Kiyoshi Ikeda; Noboru Ooishi; Hideyuki Kobayashi, all of Tokyo, Japan

[73] Assignee: Oki Daga Corporation, Tokyo, Japan

[21] Appl. No.: 09/082,611

[22] Filed: May 20, 1998

[30] Foreign Application Priority Data

May 21, 1997 [JP] Japan ..... 9-130956

[51] Int. Cl.[7] ..... B41J 2/135; B41J 2/045

[52] U.S. Cl. ..... 347/45; 347/71

[58] Field of Search ..... 310/328; 346/45; 347/27, 45, 53, 55, 68, 69, 70, 71, 72

[56] References Cited

U.S. PATENT DOCUMENTS 4,546,360 10/1985 Fischbeck et al. ..... 346/1.1
5,235,352 8/1993 Pies et al. .
5,277,813 1/1994 Pies et al. .
5,311,219 5/1994 Ochiai et al. ..... 346/140
5,481,285 1/1996 Pies et al. ..... 347/45
5,729,264 3/1998 Pankert et al. ..... 347/71

FOREIGN PATENT DOCUMENTS 5-338156 12/1993 Japan .
6-8426 1/1994 Japan .

*Primary Examiner*—Matthew S. Smith
*Assistant Examiner*—Hoang Ngo

[57] ABSTRACT

An ink jet head has a plurality of ink pressure chambers defined therein and a surface to which a plurality of ink pressure chambers open. An orifice plate having an orifice therein is bonded to the surface. When manufacturing the ink jet head, a coating of an insulating material is first formed on an inner wall of the ink pressure chambers and subsequently a re-dissolvable curingresin is applied to the ink jet head in an area from the inner walls to the surface. Then, the coating and the resin deposited on the surface are removed from the surface. Then, the resin deposited on the coating in the ink pressure chambers is dissolved to remove the resin from the inner wall. Finally, the orifice plate is bonded to the surface.

9 Claims, 5 Drawing Sheets

100
20
22
10a
21
23
10a
7
6
9
4
10a
8
10a
3
2
5
1a
10
13
12
11

INK JET HEAD HAVING AN IMPROVED COATING IN AN INK PRESSURE CHAMBER AND A METHOD OF MANUFACTURING THE SAME

BACKGROUND OF THE INVENTION

1. Field of the Invention

The present invention relates to an ink jet head and a method of manufacturing the ink jet head, the ink jet head ejecting ink drops through orifices from ink pressure chambers therein to perform a printing operation.

2. Prior Art

Some ink jet heads eject ink drops with the aid of bubbles generated by energizing heaters in the ink pressure chambers. Other ink jet heads disclosed, for example, in Japanese Patent Preliminary Publications No. 5-338156 and No. 6-8426, eject ink drops with the aid of a pressure generated by deformation of an ink pressure chamber.

These types of ink jet heads have a thin insulating coating formed on the inner wall of the ink pressure chamber. This coating prevents an electric current from flowing through the ink held in the ink pressure chamber when the ink is pressurized by the deformation of the chamber or generated bubbles.

The coating is, for example, a highly insulating silicone material having a low viscosity, and is formed by, for example, spin-coating where an insulating solution introduced into the ink pressure chamber is spread by a centrifugal force to form a layer of insulator on the inner wall of the ink pressure chamber.

After the thin coating has been formed, an orifice plate having orifices formed therein is bonded to the front end of the ink pressure chamber by an adhesive.

With the conventional method of manufacturing the ink jet heads, excessive insulating solution spreads over the front surface of the ink pressure chamber to which the orifice plate is to be bonded. Thin insulating coating materials such as silicone are highly water-repellent. Accordingly, when the orifice plate is bonded to the front surface of the ink pressure chamber, the bonding agent does not adhere to the surface on which the insulating coating remains deposited, or the adhesion of the bonding agent is very weak.

SUMMARY OF THE INVENTION

An object of the invention is to provide an ink jet head in which the adhesion of the orifice plate is improved and a method of manufacturing the ink jet head.

The ink jet head has at least one ink pressure chamber defined therein, an orifice plate, and a surface to which the orifice plate is to be bonded.

When manufacturing the ink jet head, a coating of an insulating material is first formed on an inner wall of the ink pressure chamber and then a re-dissolvable curing-resin is applied on the ink jet head in an area from the inner wall to the surface. Then, the coating and the resin deposited on the surface are removed. Then, the resin deposited on the coating formed on the inner wall of the pressure chamber is dissolved to remove the resin from the inner wall. Finally, the orifice plate is bonded to the surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of the invention will be described in detail with reference to the accompanying drawings. An ink jet head according to the embodiment is provided with ink pressure chambers that hold ink therein. The walls of the ink pressure chamber are deformed to pressurize the ink therein to eject ink drops through the orifices, thereby performing a printing operation.

First Embodiments

Figure 1:
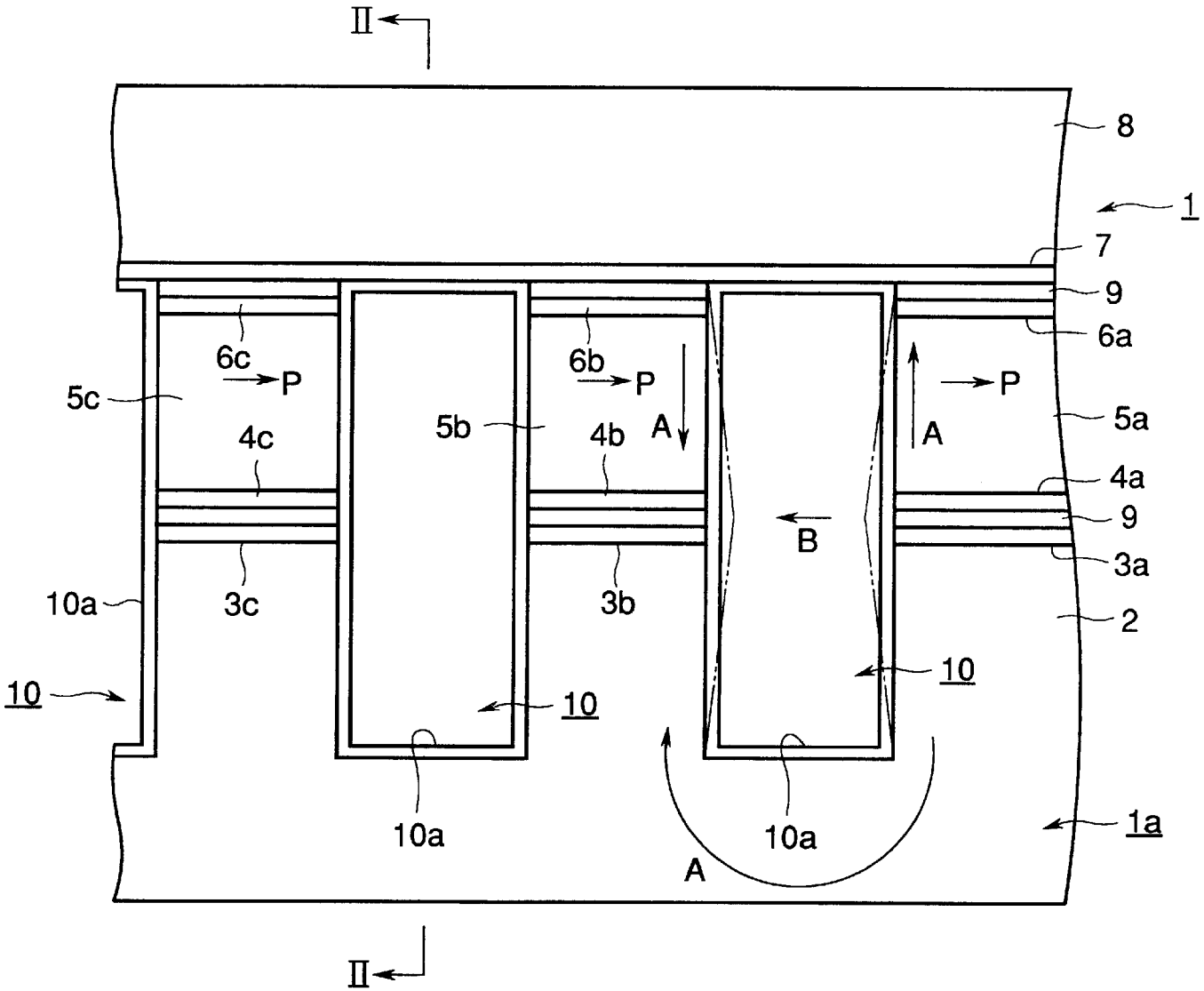
FIG. 1 is an enlarged view of a front end of the ink pressure chamber to which an orifice plate is bonded.
Figure 2:
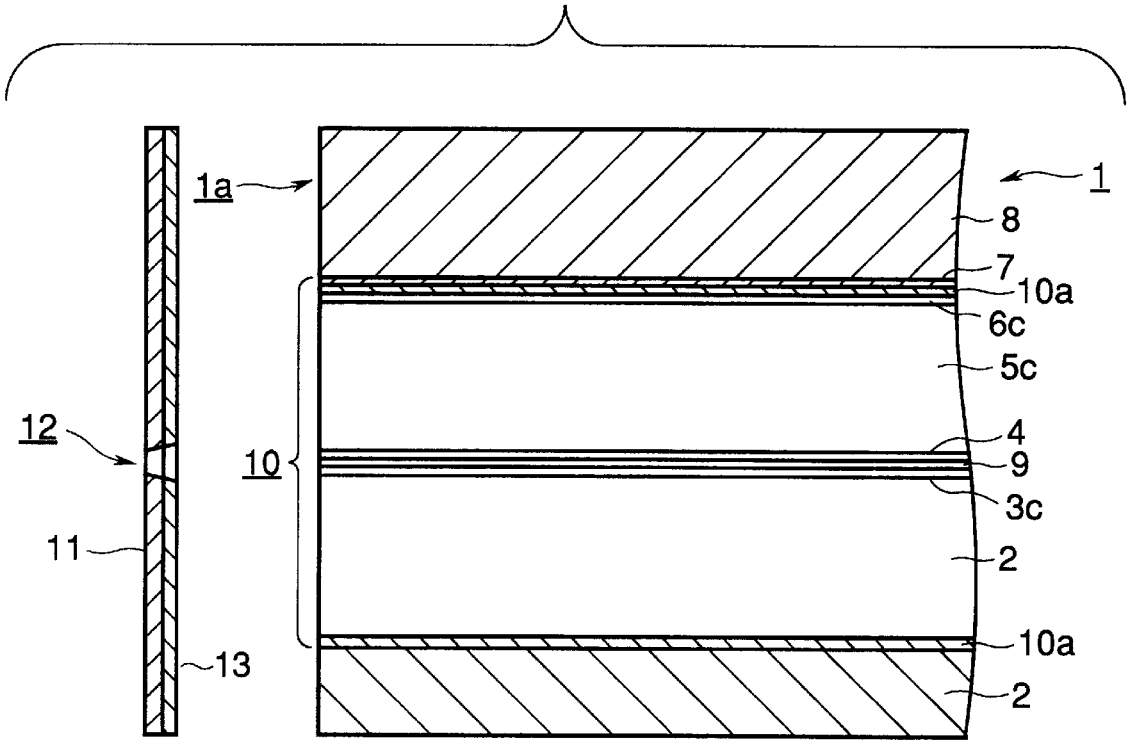
FIG. 2 is a cross-sectional side view taken along lines II—II of FIG. 1.

FIG. 1 is a fragmentary enlarged view of a front end of the ink pressure chamber of the invention to which an orifice plate is bonded. FIG. 2 is a cross-sectional side view taken along lines II—II of FIG. 1, showing a relevant portion.

Referring to FIGS. 1 and 2, an ink jet head 1 includes a piezoelectric base 2, intermediate body 5 (5*a*, 5*b*, and 5*c*), and top plate 8. The base 2 and intermediate body 5 (5*a*, 5*b*, and 5*c*) are polarized in directions shown by arrows P.

The intermediate body (5*a*, 5*b*, and 5*c*) has electrodes 4 (4*a*, 4*b*, 4*c*) and 6 (6*a*, 6*b*, 6*c*), and the top plate 8 has an electrode 7. The base 2 and the intermediate body 5 are bonded together by a conductive adhesive 9 sandwiched between the electrodes 3 (3*a*, 3*b*, 3*c*) and 4 (4*a*, 4*b*, 4*c*). The top plate 8 and the intermediate body 5 are bonded together by a conductive adhesive 9 sandwiched between the electrodes 7 and 6 (6*a*, 6*b*, 6*c*). A plurality of ink pressure chambers 10 are defined when the top plate 8, intermediate body 5, and base 2 have been bonded together.

The respective ink pressure chambers 10 have a later described insulating coating 10*a* on their inner walls. The ink pressure chambers 10 are filled with ink, not shown.

An orifice plate 11 shown in FIG. 2 is bonded by an adhesive 13 to the front end la of the ink jet head 1. The orifice pate 11 is formed with orifices 12 for corresponding ink pressure chambers 10. The orifices 12 are aligned in a direction perpendicular to the page of FIG. 2 Referring to FIG. 1, in operation, positive and negative voltages are applied to the electrode 3*a* and 3*b*, respectively, with the common electrode 7 grounded, so that an electric field is developed in directions shown by arrows A across the base 2 and the intermediate bodies 5*a* and 5*b*. The base 2 and intermediate bodies 5*a* and 5*b* are deformed in a shear mode as shown by a dot dash line in FIG. 1. This deformation applies a pressure to the ink in the ink pressure chamber 10 to eject ink drops through the orifices 12 (FIG. 2), thereby printing on the paper, not shown.

The coating 10*a* formed on the inner wall of the ink pressure chamber 10 is a few-micron thick layer of a highly insulating silicone material with a low viscosity. The coating 10*a* prevents a leakage current which may flow through the ink within the ink pressure chamber 10 (in a direction shown by arrow B in FIG. 1) when a voltage is applied to the base 2 and intermediate bodies 5*a* and 5*b* in the directions shown by arrows A.

If a leakage current flows through the ink, the electric field shown by arrow A decreases, thereby decreasing the deformation of the walls of the ink pressure chamber in the shear mode. Decreases in deformation results in smaller ink drops. Too large a decrease in deformation causes no ejection of the ink at all. The leakage current causes the electrodes 3 and 4 to corrode due to electro-chemical reaction, with the result that the ink is denatured and parts of the electrodes 3 and 4 are lost by corrosion.

Figure 4:
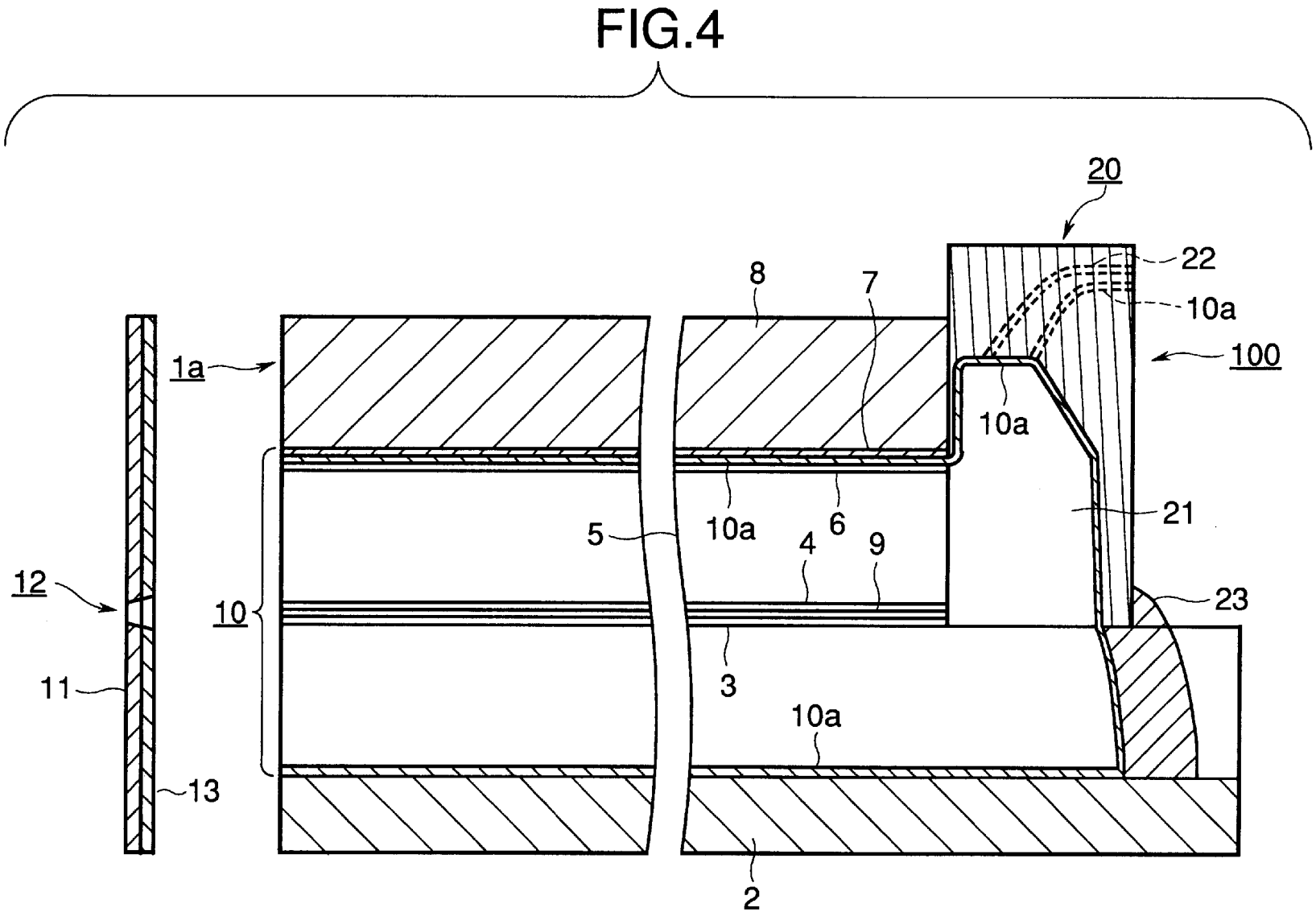
FIG. 4 is a general cross-sectional view of an ink jet head according to a second embodiment.

The rear ends of the ink pressure chambers 10 communicate with a common ink reservoir, similar to that shown in FIG. 4, from which the ink is directed to individual ink pressure chambers 10. Gaps at the rear ends are sealed by a sealing material. Thus, the ink pressure chambers 10 are sealed spaces, communicating with the outside environment only through the orifices.

The manufacturing steps of the ink jet head 1 of the first embodiment will now be described with reference to FIGS. 1, 2, and 3A–3D.

FIGS. 3A–3D illustrate the steps of manufacturing the ink jet head according to the first embodiment, and are cross-sectional fragmentary views in the vicinity of the front end of the ink pressure chamber 10.

The base 2 is bonded to the intermediate body 5 by the conductive adhesive 9 filling the gap between the electrode 3 of the base 2 and the electrode 4 of the intermediate body 5.

Figure 3A:
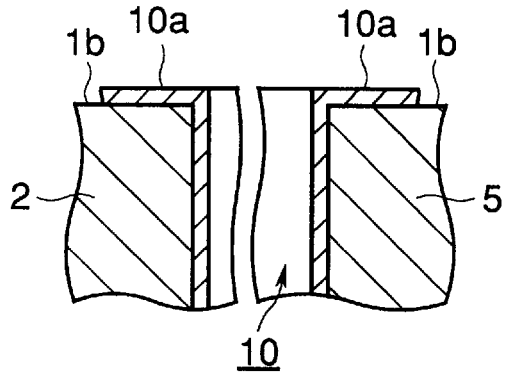
FIGS. 3A–3D illustrate the steps of manufacturing the ink jet head according to the first embodiment.

The intermediate body 5 is also bonded to the top plate 8 by a conductive adhesive 9 filling the gap between the electrode 6 of the intermediate body 5 and the common electrode 7 of the top plate 8. Bonding the base 2, intermediate body 5, and top plate 8 together into an integral structure defines the ink pressure chambers 10. Then, an insulating material such as silicone is spin-coated on the inner wall of the ink pressure chamber 10, thereby forming the thin coating 10*a* on the inner wall. At this assembly stage, the front end of the ink pressure chamber 10 is open to the environment as shown in FIG. 3A. Therefore, the insulating material is deposited on the front end surface 1*b*.

Instead of spin-coating, the insulating material may be formed by, for example, CVD (chemical vapor deposition). The ink jet head 1 is placed in a furnace in which silicon is vaporized, thereby forming the coating 10*a* on the inner wall of the ink chambers 10.

Figure 3B:
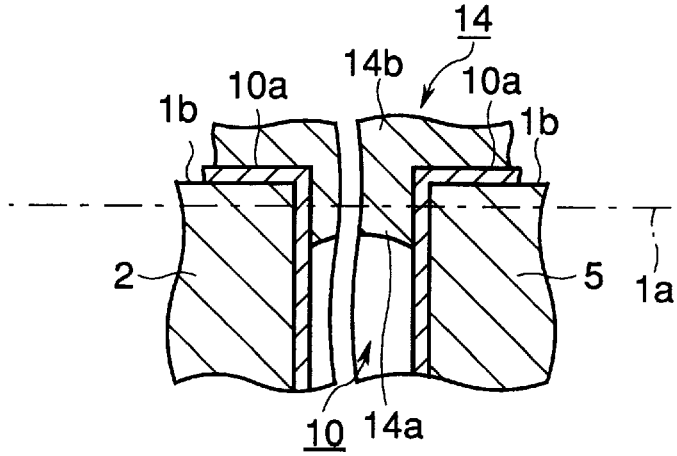

Then, as shown in FIG. 3B, a resin 14 is applied to the surface 1*b* and the resin 14 also spreads into the ink pressure chamber 10 as depicted at 14*a*. The resin 14 and 14*a* are, for example, a water-soluble acrylic ultraviolet (UV)-curing resin.

The applied resin layers 14*b* and 14*a* are UV-cured so that the resin layers 14*a* and 14*b* firmly hold the coating 10*a* against the surface 1*b* and a part of the inner wall of the ink pressure chamber 10.

Figure 3C:
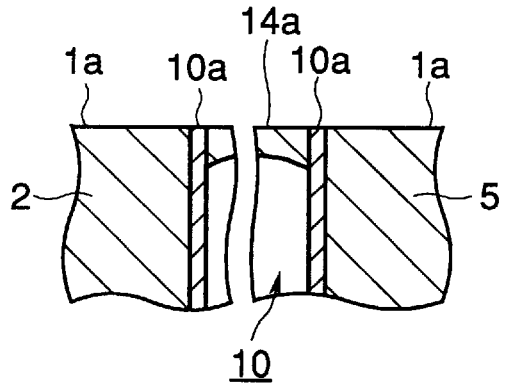
Figure 3D:
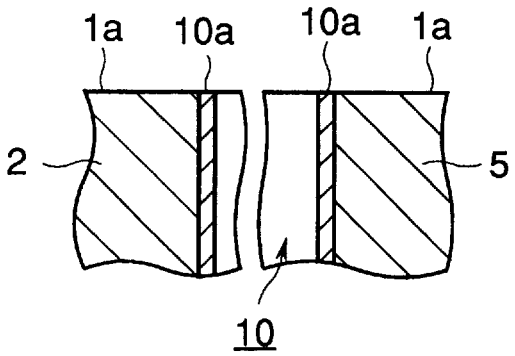

Then, as shown in FIG. 3B, the intermediate assembly of the ink jet head is subjected to a lapping operation or a dicing operation in order to remove the front surface 1*b* at a position indicated by a dot-dash line. FIG. 3C shows the ink jet head immediately after the lapping or dicing operation. During the lapping or dicing operation, the coating 10*a* formed on the inner wall of the ink pressure chamber 10 receives a force in such a direction as to detach the coating 10*a*. However, the cured resin 14*a* holds the coating 10*a* so firmly as to prevent the detachment of the coating 10*a* from the inner wall. When the front surface 1*b* has been removed at a position indicated by the dot-dash line, the resin 14*b* and coating 10*a* deposited on the front surface 1*b* are completely removed, leaving a desired surface 1*a*.

The resin 14*a* is then dissolved in water and removed from the rest of the ink jet head. After the resin 14*a* has been removed, the coating 10*a* formed on the inner wall of the ink pressure chamber 10 is exposed.

In the first embodiment, the lapping operation or dicing operation is carried out with the resin 14*b* and 14*a* firmly holding the coating 10*a*. Thus, the coating 10 is protected from damages such as detachment and tear-up of the coating 10*a* so that the insulation of the interior of the ink pressure chamber 10 is not impaired.

Although the resin material 14 and 14*a* was in the form of a water-soluble UV-curing resin, other soluble resins such as UV-curing resin may be used which is soluble in water solution of caustic sodium. The dissolution of the resin material 14 and 14*a* should be performed at temperatures below a temperature at which the polarization of the base 2 and intermediate body 5 is lost. The temperature ranges from 0 to 150° C., and preferably from 95 to 100° C. if the resin is dissolved in water, and from 10 to 30° C. if the resin is dissolved in the water solution of caustic sodium.

Second Embodiment

FIG. 4 is a general cross-sectional view of an ink jet head according to a second embodiment.

An ink jet head 100 includes a manifold 20 through which ink, not shown, is supplied to the respective ink pressure chambers 10 from an external ink tank, not shown. The manifold 20 is a molded shape which is molded from a PET resin (polyethylene terephthalate). The manifold 20 includes a common ink reservoir 21 that communicates with all the ink pressure chambers 10, and an ink supply path 22 through which ink is directed from an ink tank, not shown, to the common ink reservoir 21.

Figure 5:
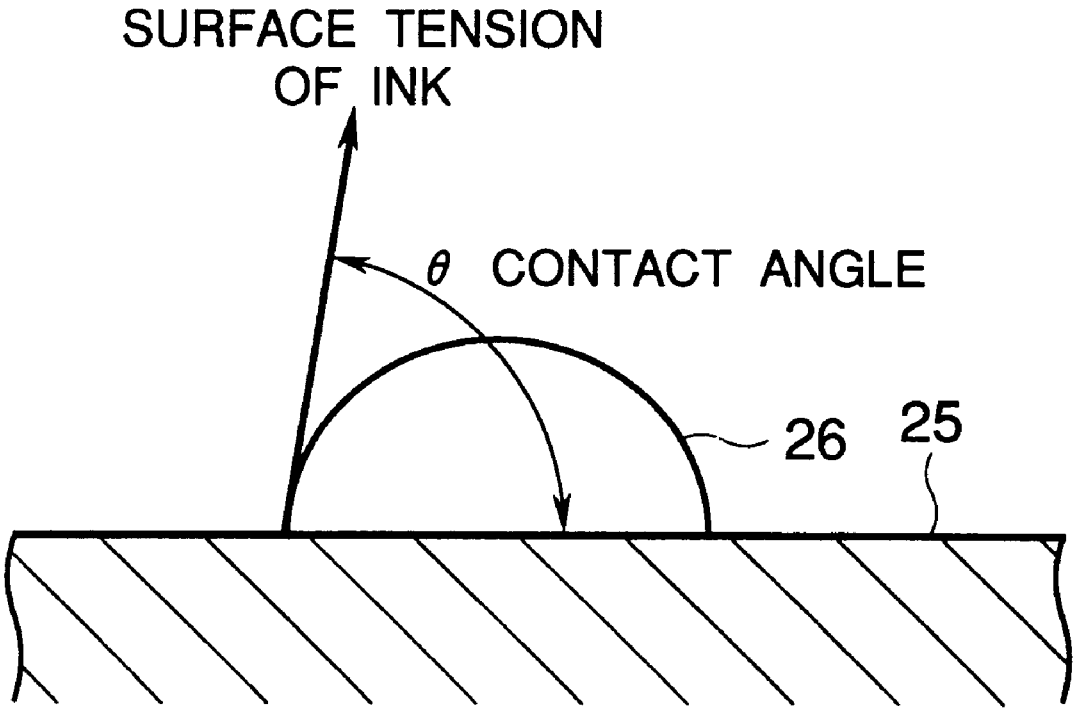
FIG. 5 illustrates the wetting of the ink with respect to the PET.

FIG. 5 illustrates the wetting of the ink with respect to the PET. The wetting of ink with respect to the PET will be described with reference to FIG. 5. Wetting is expressed by a contact angle θ. The contact angle θ is 10 to 30° for ink 26 and the PET resin 25. In contrast, the contact angle θ ranges from 50 to 90° for ink 26 and the silicone material of the coating 10*a*. Therefore, the silicone material is less wet with ink than the PET resin. In the second embodiment, the coating 10*a* is also formed on the inner walls of the common ink reservoir 21 and the ink supply path 22, thereby eliminating a difference in wetting between the manifold 20 and ink pressure chamber 10.

The ink pressure chamber 10 is sealed by a sealing material 23 except areas covered by the manifold 20 and Korifice plate 11. In other words, the ink pressure chamber 10 is a sealed space with the orifices 12 and ink supply path 22 open to the environment. Thus, a path for the ink to flow is defined in the ink jet head 100 from the ink supply path 22 to the orifice 12.

As shown in FIG. 4, the sealing material 23 closes the rear end of the ink pressure chamber 10 and therefore the coating 10*a* is also applied to the sealing material 23 in order to eliminate the difference in wetting between the ink pressure chamber 10 and the sealing material 23.

Other construction is the same as that of the first embodiment and description thereof is omitted.

The manufacturing steps of the ink jet head 100 of the second embodiment will be described with reference to FIG. 4.

The base 2 is bonded to the intermediate body 5 by the conductive adhesive 9 filling the gap between the electrode 3 of the base 2 and the electrode 4 of the intermediate body 5.

The intermediate body 5 is also bonded to the top plate 8 by the conductive adhesive 9 filling the gap between the electrode 6 of the intermediate body 5 and the common electrode 7 of the top plate 8. Bonding the base 2, intermediate body 5, and top plate 8 together into an integral structure defines the ink pressure chambers 10. Then, the manifold 20 is assembled to the base 2, intermediate body 5, and top plate 8 so that the respective ink pressure chambers 10 communicate with the common ink reservoir 21. Then, the areas that are not closed by the manifold 20 are sealed by the sealing material 23.

An insulating material such as silicone is spin-coated to the inner walls of the ink pressure chambers 10 to form the thin coating 10*a*. During this process, the coating 10*a* having a thickness of several microns is formed on the front end 1*a* of the ink pressure chamber 10 and the inner walls of the common ink reservoir 21 and ink supply path 22.

The coating 10*a* may be formed by other process such as CVD. The CVD is advantageous in that the coating 10*a* can easily be formed even if the shapes of the common ink reservoir 21 and ink supply path 22 are complicated.

The manufacturing steps beyond this stage are the same as the first embodiment and description thereof is omitted.

Air bubbles enter the ink supply path when an old ink tank is replaced for a new, unused ink tank, and the ink supply path is exposed to the air. The air bubbles are often mixed with the ink. The air bubbles gradually migrate toward the orifices during the printing operation and cause insufficient ejection of the ink drops. Therefore, the air bubbles entered the ink pressure chambers are ejected through the orifices by forcibly sucking the bubbles or by performing dummy ejection of ink drops onto an ink basin when not printing.

If the wetting of ink is not uniform along the passage from the ink supply path to the ink pressure chambers, the flow of ink is disturbed in the printing operation and air-ejecting operation.

The disturbance may cause an eddy of the ink at a boundary layer where the ink moves into contact with the inner walls of the ink pressure chamber. The air bubbles are apt to stay at the boundary layer due to the eddy, and cannot move toward the orifices. The air bubbles due to the turbulent flow of ink may stick together into larger bubbles to cause insufficient ejection of ink drops.

In the second embodiment, the inner walls of the ink supply path 22 through the respective ink pressure chambers 10 have uniform ink-wetting, thereby preventing turbulent flow of ink. The uniform ink-wetting allows smooth discharge of the air bubbles which have been mixed into the ink, improving the print quality of the ink jet printer.

Although the coating 10*a* has been described with respect to a layer of silicone in the first and second embodiments, the coating 10*a* is not limited to silicone and may be formed in other techniques.

While the first and second embodiments have been described with respect to an ink jet printer where ink is pressurized by the shear mode deformation of the base 2 and intermediate body 5, the present invention may also be applicable to other ink jet printers where the piezoelectric element directly pressurizes the ink to eject ink drops through the orifices and ink jet printers where the ink is pressurized by air bubbles generated in the ink chambers to print dots.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of manufacturing an ink jet head, the ink jet head having at least one ink pressure chamber defined therein, an orifice plate having an orifice corresponding to the ink pressure chamber, and a surface to which the orifice plate is bonded, the method comprising the steps of:

forming a coating of an insulating material on an inner wall of the ink pressure chamber;

applying a soluble curing-resin on the coating, the curing resin covering at least the coating in the vicinity of the surface;

removing the coating and the curing-resin deposited on the surface, after the curing-resin has cured;

removing the curing-resin deposited on the coating in the ink pressure chamber by dissolving the curing-resin; and bonding the orifice plate to the surface.

2. The method according to claim 1, wherein the coating and the curing-resin deposited on the surface are removed by removing a part of the ink jet head by a plane substantially parallel to the surface.

3. The method according to claim 2, wherein the coating and the curing-resin deposited on the surface are removed by a lapping operation.

4. The method according to claim 1, wherein said curing resin is dissolved at temperatures in the range from 0 to 150° C.

5. The method according to claim 1, wherein said curing resin is a water-soluble curing-resin.

6. The method according to claim 1, wherein said ink jet head includes a plurality of ink pressure chambers and a common ink reservoir which communicates with all of the ink pressure chambers and has an ink supply path for receiving ink from an external ink tank, wherein the common ink reservoir is assembled to the ink jet head after the coating of the insulating material has been formed on inner walls of the ink pressure chambers.

7. The method according to claim 1, wherein said ink jet head includes a plurality of ink pressure chambers and a common ink reservoir which communicates with all of the ink pressure chambers and has an ink supply path for receiving ink from an external ink tank, wherein the coating of the insulating material is formed on inner walls of the ink pressure chambers and the common ink reservoir after the ink pressure chambers are assembled to the common ink reservoir.

8. An ink jet head, comprising:

a plurality of ink pressure chambers;

a common ink reservoir which communicates with all of the ink pressure chambers; and an ink supply path for directing ink from an external ink tank to said common ink reservoir;

wherein a coating of an insulating material is formed on inner walls of the ink pressure chambers, the ink supply path, and the common ink reservoir.

9. The ink jet head according to claim 8, wherein the insulating material causes the inner walls of the ink pressure chamber, the ink supply path and the common ink reservoir to have uniform ink-wetting characteristics, thereby preventing turbulent flow of ink.

* * * * *